US005816864A

United States Patent [19]

Creelle

[11] Patent Number: 5,816,864

[45] Date of Patent: Oct. 6, 1998

[54] CONNECTOR ASSEMBLY

[75] Inventor: Eddy K. Creelle, Sint Gillis Dendermonde, Belgium

[73] Assignee: Framatome Connectors USA Inc., Fairfield, Conn.

[21] Appl. No.: 922,118

[22] Filed: Aug. 28, 1997

Related U.S. Application Data

[63] Continuation of Ser. No. 532,916, Sep. 21, 1995, abandoned.

[51] Int. Cl.[6] ..... H01R 13/432

[52] U.S. Cl. ..... 439/752.5

[58] Field of Search ..... 439/380, 381, 439/752.5

[56] References Cited

U.S. PATENT DOCUMENTS 4,358,179 11/1982 Bourdon ..... 339/217
5,195,913 3/1993 Shattuch ..... 439/752.5
5,350,292 9/1994 Sanders et al. ..... 439/752.5

FOREIGN PATENT DOCUMENTS 0516937 4/1992 European Pat. Off. .
9007807 7/1990 WIPO .

*Primary Examiner*—Gary F. Paumen
*Attorney, Agent, or Firm*—Perman & Green, LLP

[57] ABSTRACT

A connector assembly comprises male and female connectors, wherein each connector includes a housing which is substantially circular in cross section and has front and back sides. Each housing is provided with a plurality of channels extending between the front and back sides. A male or female contact member respectively is received in each channel. Further a plurality of guiding members is provided in each channel at the front side of the housing for guiding the corresponding contact member, said guiding members being uniformally distributed along the circumference of the channel. The guiding members are for example made as a rib projecting inwardly into the channel and made in one piece with the housing.

5 Claims, 1 Drawing Sheet

CONNECTOR ASSEMBLY

This application is a continuation of application Ser. No. 08/532,916 filed on Sep. 21, 1995, now abandoned.

FIELD OF THE INVENTION

The invention relates to a connector assembly comprising a male connector and a female connector, wherein each connector includes a housing which is substantially circular in cross-section, wherein each housing has front and back sides and is provided with a plurality of channels extending between the front and back sides, wherein a male or female contact member, respectively, is received in each channel.

SUMMARY OF THE INVENTION

The invention aims to provide a connector assembly of this type wherein at equal dimensions of the housing a higher number of contact members can be mounted in the housing.

To this end the connector assembly of the invention is characterized in that a plurality of guiding members is provided in each channel at the front side of the housing for guiding the corresponding contact member, said guiding members being uniformally distributed along the circumference of the channel.

In this manner, despite reducing the dimensions of the contact members and the channels, a reliable coupling of the male and female contact members in the coupled position of the connectors is guaranteed. The guiding members hold the male contact member aligned with the channel of the corresponding female contact member in a sufficient manner and further prevent that the male contact member can be inserted between the wall of the channel and the female contact member.

The invention will be further explained by reference to the drawings in which a connector assembly according to the invention is schematically shown.

DETAILED DESCRIPTION OF THE PREFERRED EMBODIMENT

Figure 1:
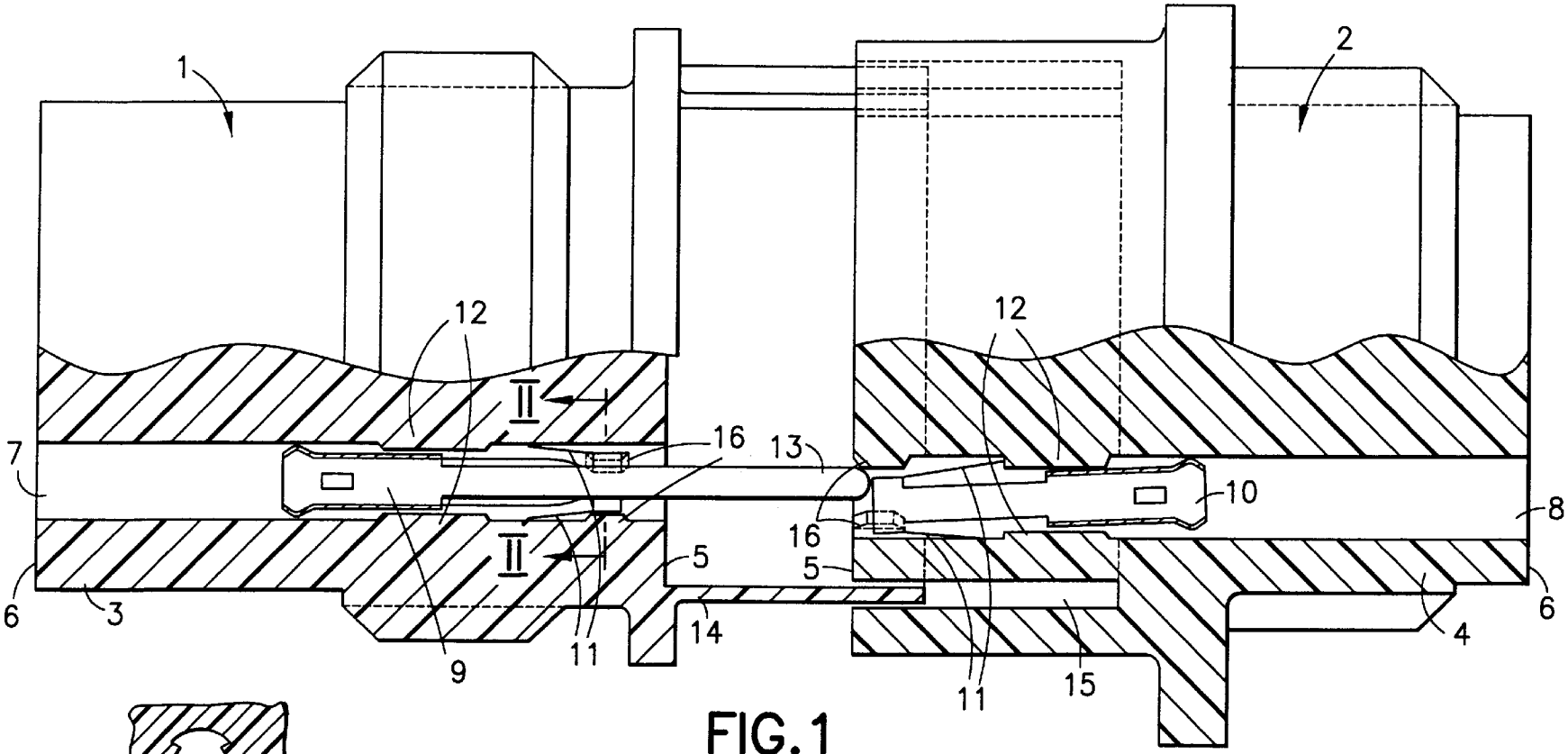
FIG. 1 shows very schematically a longitudinal section of the connector assembly according to the invention.
Figure 2:
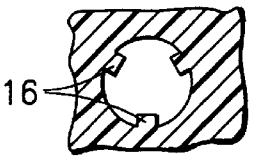
FIG. 2 shows a cross-section according to the line. II—II in FIG. 1 wherein the contact member is not shown.

FIG. 1 shows very schematically a connector assembly comprising a male connector 1 and a female connector 2. Each connector has a housing 3 or 4, respectively having a substantially circular cross-section and having a front side 5 and a back side 6. Channels 7 and 8, respectively are formed in each housing 3,4 extending between the front side 5 and the back side 6 of the housing 3,4. In each channel 7 and 8, respectively a male contact member 9 or a female contact member 10, respectively, is received.

The contact members 9,10 are pushed into the housing 3,4 from the back side 6, wherein resilient lips 11 are adapted to pass a column or restriction 12 and to lock the contact member in the channel after passing the column 12.

In order to provide a higher number of channels 7,8 or contact members 9,10 in the housing 3,4, the dimensions of the channels 7,8 and the contact members 9,10 are decreased with respect to the usual dimensions. By way of example it is noted that channels 7,8 has a diameter of 2.5 mm and the pin section 13 of the male contact member 9 a diameter of 1.0 mm.

With such a decrease of the dimensions problems may occur during inserting the contact members 9 into the contact members 10. This problem is caused by the fact that on one side the contact members 9,10 are lying in the channels 7,8 with play and on the other side a cylindrical sleeve 14 of the housing 3 fits with play in a cylindrical slot 15 of the housing 4 so that the channels 7 and 8 are not necessarily accurately aligned. It is known to overcome this problem by assembling the housing 3,4 from two parts wherein a closed guiding frame is mounted at the front side of the housing 3,4. In that case, the housing has to be assembled of two parts whereby the costs are increased and manufacturing becomes complicated.

With the connector assembly described this problem is overcome by providing three ribs 16 uniformly along the circumference in each channel, said ribs protruding inwardly into the corresponding channel 7,8. These ribs 16 are made unitary with the housing whereby the costs are hardly increased and manufacturing remains simple. As show in FIG. 1, the ribs 16, in each channel 7, 8, contact the resilient lips 11 on the corresponding contact members 9, 10. These ribs 16 operate as guiding members for the contact members 9,10 and guarantee that the pin sections 13 of the male contact members 9 are inserted in the correct manner into the corresponding female contact members.

The housing 3,4 of the connector 1,2 is therefore advantageously made as a unit.

The invention is not restricted to the above described embodiment which can be varied in a number of ways within the scope of the claims.

What is claimed is:

1. A connector assembly comprising a male connector and a female connector, wherein each connector includes a housing which is substantially circular in cross-section, wherein each housing has front and back sides and is provided with a plurality of channels extending between the front and back sides, wherein a male or female contact member, respectively, is received in each channel, characterized in that the male and female contact members have resilient latch arms compressed when inserted in each channel by a restriction therein, the latch arms engage a portion of the housing affixing the contact to the channel and wherein each channel has a plurality of guiding members at the front side of the housing contacting the latch arms on the corresponding contact member without interfering with engagement between the latch arms and the portion of the housing so that front ends of the contacts are generally aligned with opposing channels.

2. Connector assembly according to claim 1, characterized in that each of the guiding members is made as a rib projecting inwardly into the channel and made in once piece with the housing.

3. Connector assembly according to claim 1 or 2, characterized in that the housing is made as one part.

4. A connector assembly according to claim 1, wherein the guiding members are uniformly distributed along the circumference of the respective channel.

5. An electrical connector comprising:

an electrical contact having resilient arms at a front end of the contact with latching lips; and a housing with a contact channel, the contact channel having a plurality of inwardly extending ribs at a front end of the channel and a restriction located behind the ribs, wherein the electrical contact is located in the contact channel, the arms being deflected by the restriction as the contact is inserted into the channel, the lips latching in front of the restriction, and a front of the contact being centered in the channel by the ribs contacting the latching lips at the front of the channel without interfering with the latching of the lips in front of the restriction.

* * * * *